US006166613A

United States Patent [19]

Nakagawa et al.

[11] Patent Number: 6,166,613

[45] **Date of Patent: *Dec. 26, 2000**

[54] VOLTAGE-CONTROLLED RESONATOR, METHOD OF FABRICATING THE SAME, METHOD OF TUNING THE SAME, AND MOBILE COMMUNICATION APPARATUS

[75] Inventors: Yoshihiro Nakagawa, Osaka; Koichi Ogawa, Hirakata; Toshio Ishizaki, Kobe; Makoto Sakakura, Uji; Toshiaki Nakamura, Nara, all of Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,908

[22] Filed: Jul. 18, 1997

[30] Foreign Application Priority Data

Jul. 18, 1996 [JP] Japan ..... 8-188975

[51] Int. Cl.[7] ..... H01P 1/203

[52] U.S. Cl. ..... 333/205; 333/235; 333/247

[58] Field of Search ..... 333/204, 205, 333/219, 235, 246, 247

[56] References Cited

U.S. PATENT DOCUMENTS

| | | | |
|---|---|---|---|
| 4,835,499 | 5/1989 | Pickett | 333/205 |
| 5,014,024 | 5/1991 | Shimizu et al. | 333/205 X |
| 5,321,374 | 6/1994 | Uwano | 333/205 X |
| 5,475,350 | 12/1995 | Yamada et al. | 333/223 |
| 5,654,681 | 8/1997 | Ishizaki et al. | 333/219 X |

FOREIGN PATENT DOCUMENTS

| | | | |
|---|---|---|---|
| 2-135802 | 5/1990 | Japan | 333/247 |
| 4-144402 | 5/1992 | Japan | 333/247 |
| 5-75313 | 3/1993 | Japan | 333/247 |
| 5-129810 | 5/1993 | Japan | 333/219 |

*Primary Examiner*—Justin P. Bettendorf

*Attorney, Agent, or Firm*—Smith, Gambrell & Russell, LLP

[57] ABSTRACT

A voltage-controlled resonator is fabricated by laminating, one on top of the other, a first dielectric which has a resonant circuit and on the upper surface of which a variable-capacitance element is mounted, and a second dielectric which has a through-hole formed in a position thereof corresponding to the position of the variable-capacitance element and which has a dual function of shielding and resonant frequency tuning. With this structure, the height of the resonator can be further reduced compared with the prior art while retaining the shielding effect, and moreover, further precise resonant frequency tuning can be accomplished as compared with the prior art.

22 Claims, 5 Drawing Sheets

VOLTAGE-CONTROLLED RESONATOR, METHOD OF FABRICATING THE SAME, METHOD OF TUNING THE SAME, AND MOBILE COMMUNICATION APPARATUS

BACKGROUND OF THE INVENTION

1. Field of the Invention

The present invention relates to a voltage-controlled resonator that can be used in a high-frequency filter and oscillator circuit, a method of fabricating the same, a method of tuning the same, and a mobile communication apparatus.

2. Description of the Related Art

In a voltage-controlled resonator, it is important to maintain a required resonant frequency. Furthermore, the need to reduce the size and cost of voltage-controlled resonators has been growing in recent years.

A voltage-controlled resonator such as described in U.S. Pat. No. 5,475,350 has been known in the prior art. In the case of this resonator, the construction is such that a variable-capacitance element and a circuit pattern formed on the upper surface of a dielectric forming a resonant circuit are exposed, i.e., no shield function is incorporated in the structure. Accordingly, this prior art resonator has had the shortcoming that because of its poor shielding properties, its resonant frequency is shifted (deviated) from the design value when a dielectric substance is brought close to it. To overcome this shortcoming, an arrangement such as that shown in FIG. 5(C) has been devised in which, after mounting the voltage-controlled resonator on an apparatus circuit board 310, a shield case 309 is mounted covering the entire apparatus circuit board 310.

Referring now to FIGS. 5(A) to 5(C), one example of the above prior art voltage-controlled resonator will be described.

FIG. 5(A) is a perspective view of the prior art voltage-controlled resonator, and FIG. 5(B) is a side cross-sectional view of FIG. 5(A). FIG. 5(C) is a side cross-sectional view showing the condition in which the shield case 309 is mounted covering the entire apparatus circuit board 310 on which the voltage-controlled resonator of FIG. 5(A) has been mounted.

In FIGS. 5(A) and 5(B), reference numeral 301 is a dielectric where a resonant circuit is formed, 302 is an internal electrode of the dielectric 301, 303 is a circuit pattern formed on the upper surface of the dielectric 301, 304 is a variable-capacitance element mounted on the dielectric 301, 305 are terminal electrodes for connecting an external circuit, and 306 is a tuning pattern formed on the upper surface of the dielectric 301.

The operation of the thus constructed voltage-controlled resonator will be described below.

In the voltage-controlled resonator shown in FIGS. 5(A) to 5(C), the resonant circuit is formed by the internal electrode 302 of the dielectric 301, and the variable-capacitance element 304 is electrically connected to the resonant circuit so that the resonant frequency of the resonant circuit can be changed. The controlling voltage for the variable-capacitance element is supplied from an external circuit through the terminal electrodes 305 and through the circuit pattern 303.

By mounting the shield case 309 over the entire construction after mounting the above voltage-controlled resonator on the apparatus circuit board 310, resonant frequency shifts due to effects from the external circuit can be suppressed.

Mounting the shield case 309, however, has the undesirable side effect of increasing the resonant frequency of the voltage-controlled resonator.

To suppress such a resonant frequency shift resulting from the mounting of the shield case 309, frequency tuning is performed by shaving the tuning pattern 306.

More specifically, in the above case, since the size of the shield case is large, the amount of the frequency shift is also large. When the amount of shift is large, it has been the practice to remove the mounted shield case once again, shave the tuning pattern 306, measure the resonant frequency, and check if it falls within tolerance, in order to bring it close to the design value. If the resonant frequency is still outside the tolerance, the above adjustment work has had to be repeated as many times as necessary until the resonant frequency is brought within the tolerance.

As a measure to keep the amount of the resonant frequency shift as small as possible, the arrangement shown in FIG. 5(D) has been devised in which an individual shield case 311 is mounted over the voltage-controlled resonator to provide the shielding.

While this arrangement has been able to reduce the amount of the resonant frequency shift to some degree, adjustment work similar to that described above has had to be performed, and since the mounting condition changes in a delicate manner each time the shield case is mounted, it has been difficult to precisely tune the resonant frequency.

Besides, the shortcoming of increased height of the voltage-controlled resonator itself has remained unresolved.

A further problem has been that mounting the shield case not only increases the complexity of the fabrication process but also requires that the size of the dielectric 301 be increased, thus increasing the cost.

SUMMARY OF THE INVENTION

In view of the above-outlined problems of the prior art voltage-controlled resonator, it is an object of the present invention to provide a voltage-controlled resonator whose height can be further reduced compared with the prior art while retaining the shielding effect.

It is also an object of the present invention to provide a method of fabricating a voltage-controlled resonator, capable of further simplifying the fabrication of the voltage-controlled resonator.

It is also an object of the present invention to provide a method of tuning a voltage-controlled resonator, capable of accomplishing further precise resonant frequency tuning compared with the prior art.

To achieve the above objects, the voltage-controlled resonator of the first embodiment according to the invention comprises: a first dielectric having a resonant circuit; a variable-capacitance element mounted on an upper surface of said first dielectric; and a second dielectric (1) having a shield film , (2) having a through-hole formed in a position corresponding to the position of said variable-capacitance element, and (3) provided on the upper surface of said first dielectric.

A method of fabricating a voltage-controlled resonator of the second embodiment according to the invention, comprises the steps of: forming a circuit pattern of a resonant circuit on a dielectric sheet, thereby forming a first dielectric; forming a shield film on another dielectric sheet and forming a prescribed through-hole, thereby forming a second dielectric; laminating said first dielectric and said second dielectric together; and mounting a variable-capacitance element on said circuit pattern by using said through-hole.

The third embodiment according to the invention is a method of tuning a voltage-controlled resonator, wherein when there is a shift in the resonant frequency of the voltage-controlled resonator of the first embodiment according to the invention, said shift is reduced by removing a portion of the shield film.

The fourth embodiment according to the invention is a method of tuning a voltage-controlled resonator, wherein when there is a shift in the resonant frequency of the voltage-controlled resonator fabricated by the voltage-controlled resonator fabrication method of the second embodiment according to the invention, said shift is reduced by removing a portion of the shield film.

The fifth embodiment according to the invention is a mobile communication apparatus in which a voltage-controlled resonator according to the first embodiment according to the invention is used.

The sixth embodiment according to the invention is a mobile communication apparatus in which a voltage-controlled resonator is used, said voltage-controlled resonator being fabricated by the voltage-controlled resonator fabrication method according to the second embodiment according to the invention.

The seventh embodiment according to the invention is a mobile communication apparatus in which a voltage-controlled resonator is used, said voltage-controlled resonator being tuned by the voltage-controlled resonator tuning method according to the third embodiment according to the invention.

The eight embodiment according to the invention is a mobile communication apparatus in which a voltage-controlled resonator is used, said voltage-controlled resonator being tuned by the voltage-controlled resonator tuning method according to the fourth embodiment according to the invention.

With this structure, the height of the voltage-controlled resonator, for example, can be reduced, the fabrication of the voltage-controlled resonator can be further simplified, and further precise tuning of the resonant frequency can be accomplished.

DESCRIPTION OF THE REFERENCE NUMERALS

101, 102. Dielectric, 103. Through-hole, 104. Electrode film forming a resonator, 105, 106, 110. Grounding electrode film, 107. Variable-capacitance element, 108, 113, 117. Electrode film forming a capacitor, 109. Electrode film for connecting the variable-capacitance element, 111, 112. Grounding terminal electrode, 114, 116. Terminal electrode, 115. Electrode film forming choke circuit, 130. Resonator, 131, 133, 134, 137. Capacitor, 132, 139. Terminal electrode, 135. Variable-capacitance element, 136. Electrode film choke circuit

DESCRIPTION OF THE PREFERRED EMBODIMENTS

The preferred embodiments of the present invention will be described below with reference to the accompanying drawings.

(Embodiment 1)

The construction of a voltage-controlled resonator according to one embodiment of the present invention will be described with reference to drawings.

Figure 1A:
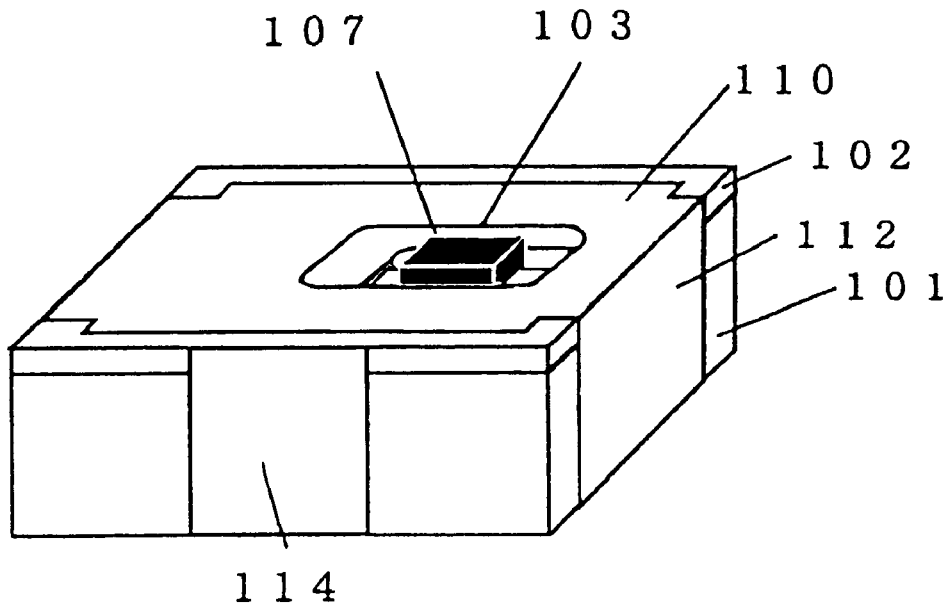
FIG. 1(A) is a perspective view of a voltage-controlled resonator according to a first embodiment of the present invention.
Figure 1B:
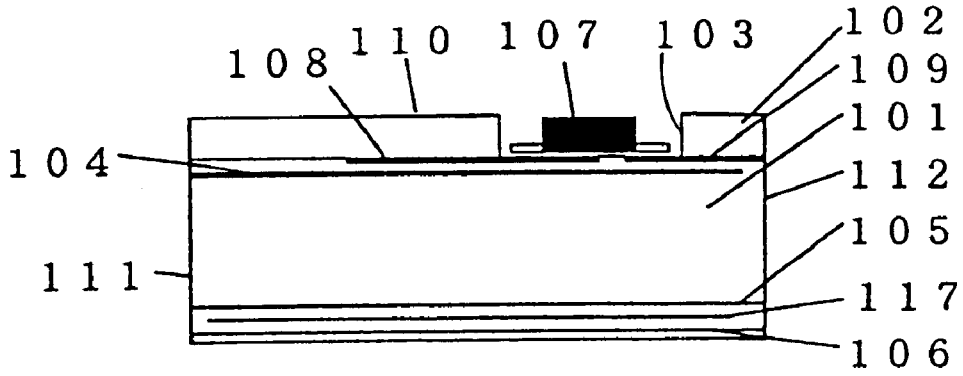
FIG. 1(B) is a side cross-sectional view of the voltage-controlled resonator according to the first embodiment of the present invention.
Figure 2:
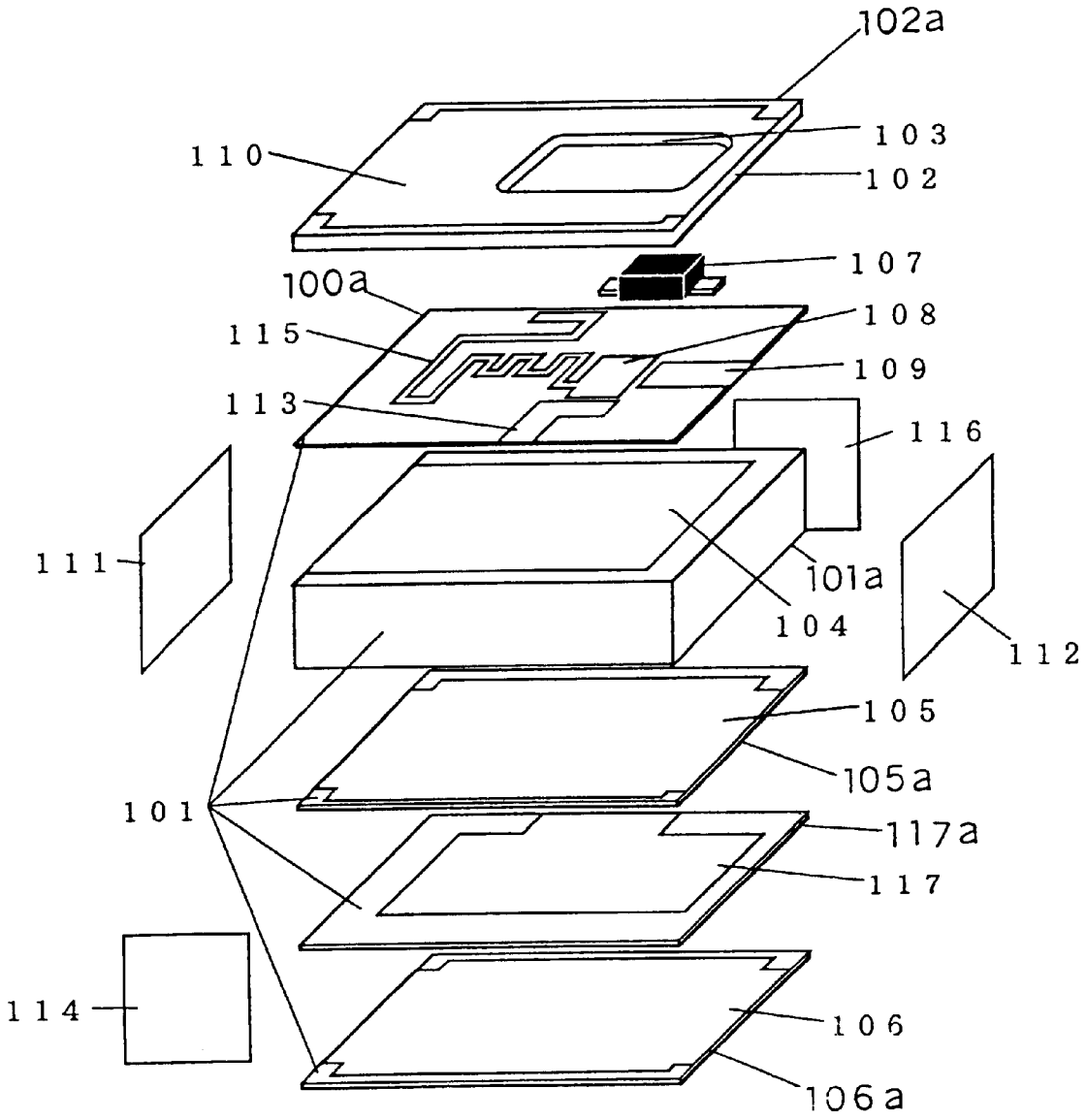
FIG. 2 is an exploded perspective view of the voltage-controlled resonator according to the first embodiment of the present invention.
Figure 3A:
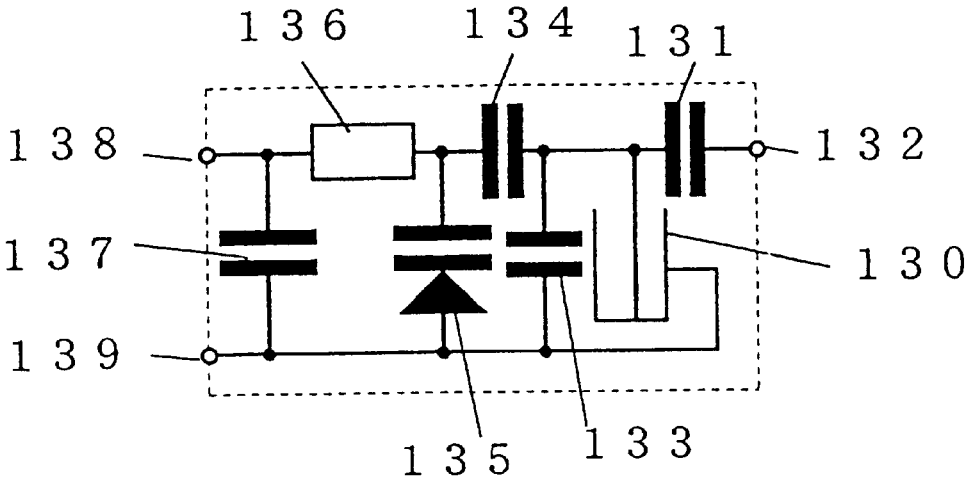
FIG. 3(A) is an equivalent circuit diagram of the voltage-controlled resonator according to the first embodiment of the present invention.

FIG. 1(A) is a perspective view of the voltage-controlled resonator according to the first embodiment of the present invention, FIG. 1(B) is a side cross-sectional view of the voltage-controlled resonator, FIG. 2 is an exploded perspective view of the voltage-controlled resonator, and FIG. 3(A) is an equivalent circuit diagram of the voltage-controlled resonator.

In FIGS. 1(A), 1(B), and 2, reference numeral 101 is a first dielectric where a resonant circuit is formed; 102 is a second dielectric overlaid on top of the dielectric 101; 103 is a through-hole formed in the second dielectric 102; 104 is a $\lambda/4$ strip resonator which is an electrode film for forming the resonator circuit; 105 and 106 are grounding electrode films formed in the dielectric 101; 107 is a variable-capacitance element mounted on the first dielectric; 108 is an electrode film for forming a capacitor which electrically couples the resonant circuit formed in the first dielectric 101 to the variable-capacitance element; 109 is an electrode film for connecting the variable-capacitance element; 110 is a grounding electrode formed on the second dielectric 102; 111 is a grounding terminal electrode, formed on one side of the first electrode 101, for connecting the electrode film 104 to the grounding electrode films 105, 106, and 110, and for connecting to an external circuit; 112 is a grounding terminal electrode, formed on another side of the first electrode 101, for connecting the electrode film 109 to the grounding electrode films 105, 106, and 110, and for connecting to the external circuit; 113 is an electrode film forming a capacitor for connecting between the resonant circuit formed in the first dielectric 101 and the external circuit; 114 is a terminal electrode for connecting the electrode film 113 to the external circuit; 115 is an electrode film for forming a choke circuit for supplying a controlling voltage to the variable-capacitance element; 116 is a terminal electrode for connecting the electrode film 115 to the external circuit; and 117 is an electrode film forming a capacitor for connecting the terminal electrode to the grounding electrodes 105 and 106 by high-frequency coupling.

Further, in FIG. 3(A), reference numeral 130 is the resonator formed by the electrode film 104, grounding electrode film 105, and grounding terminal electrode 111 formed in or on the first dielectric 101; 131 is the capacitor formed by the electrode films 104 and 113 facing each other; 132 is the terminal electrode 114; 133 is the capacitor formed by the electrode films 104 and 109 facing each other; 134 is the capacitor formed by the electrode films 104 and 108 facing each other; 135 is the variable-capacitance element 107; 136 is the choke circuit formed by the electrode film 115; 137 is the capacitor formed by the electrode film 117 facing the grounding electrode films 105 and 106; 138 is the terminal electrode 116; and 139 is the grounding terminal electrodes 111 and 112. Here, the shield film of the present invention corresponds to the grounding electrode film 110.

The operation of the thus constructed voltage-controlled resonator will be described below with reference to FIGS. 1(A), 1(B), 2, and 3(A).

In the voltage-controlled resonator of the first embodiment, the capacitor 134 and the variable-capacitance element 135 are connected in parallel to the resonant circuit 130, and by varying the voltage applied between the terminal electrode 138 and the grounding terminal electrode 139, the capacitance value of the variable-capacitance element 135 is varied, as a result of which the resonant frequency as viewed from the terminal electrode 132 changes. The circuit elements that determine the resonant frequency at this time are the resonant circuit 130, the capacitors 131, 133, and 134, and the choke circuit 136; since the electrode films 104, 108, 109, 113, and 115 corresponding to these elements are all shielded by the grounding electrode film 110 so that electromagnetic field radiation is small, the amount of the resonant frequency shift caused by external effects, as viewed from the terminal electrode 132, is reduced.

Figure 5A:
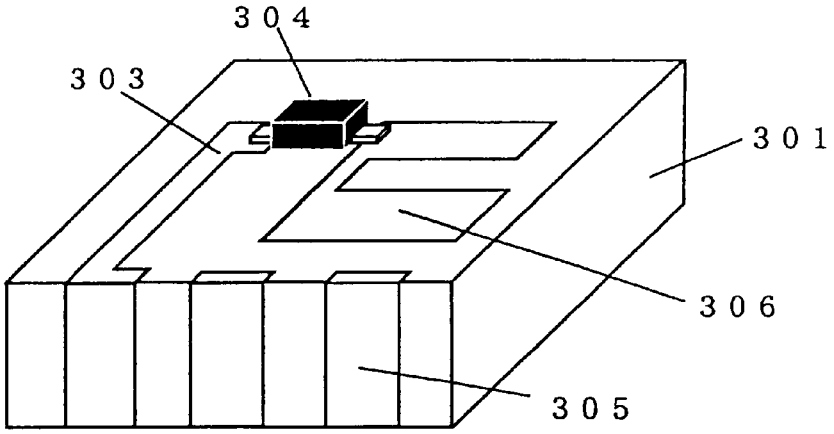
Fig. 5(A) PRIOR ART
FIG. 5(A) is a perspective view of a prior art voltage-controlled resonator.
Figure 5B:
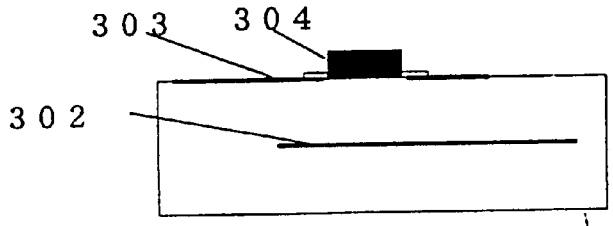
Fig. 5(B) PRIOR ART
FIG. 5(B) is a side cross-sectional view of the prior art voltage-controlled resonator.
Figure 5C:
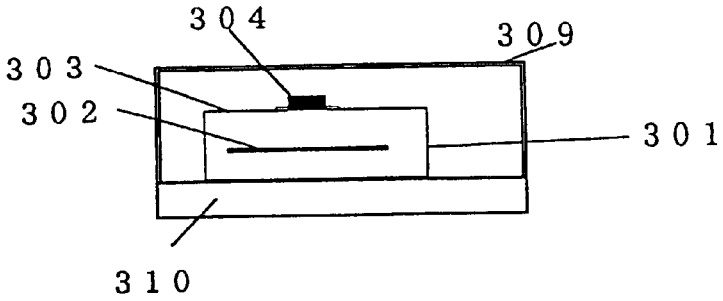
Fig. 5(C) PRIOR ART
FIG. 5(C) is a side cross-sectional view showing the prior art voltage-controlled resonator mounted on an apparatus circuit board.
Figure 5D:
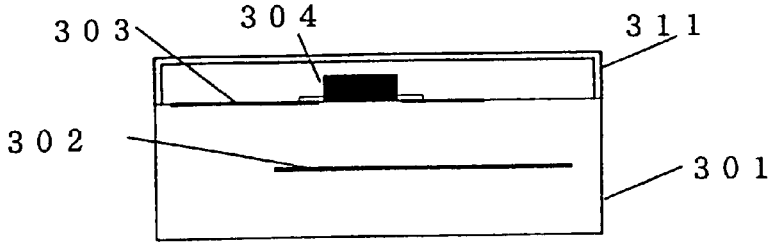
Fig. 5(D) PRIOR ART
FIG. 5(D) is a side cross-sectional view showing the condition in which a shield case is mounted over the prior art voltage-controlled resonator.

When the voltage-controlled resonator having the structure shown in FIG. 1(A) is compared with the voltage-controlled resonator having the structure shown in FIG. 5(D), the following can be said of the amount of the resonant frequency shift caused by the shielding.

In the voltage-controlled resonator having the structure shown in FIG. 1(A), the difference between the resonant frequency before forming the grounding electrode film 110 having the shield function and the resonant frequency after forming the same is smaller than the difference between the resonant frequency before mounting the shield case and the resonant frequency after mounting the same in the voltage-controlled resonator having the structure shown in FIG. 5(D). This is because in the former structure at least the through-hole 103 is formed in the shield surface and the shield area is correspondingly smaller than in the latter structure.

In practical applications, the shielding effect is relatively unaffected by the presence of the through-hole 103 for the following reason. The through-hole 103 is of a size just sufficient to allow the insertion of the variable-capacitance element 107, and has no ill effect on major circuit patterns such as the electrode film 115 forming the choke circuit. Also, the variable-capacitance element 107 is already shielded by itself.

In the present embodiment, a $\lambda/4$ strip-type resonant circuit is used as the resonant circuit, but the resonant circuit need not be limited to this particular type. It will be recognized that the same effect can be obtained with a resonant circuit of another type, for example, an LC-type resonant circuit, a coaxial-type resonant circuit, a ring-type resonant circuit, or a $\lambda/2$ strip-type resonant circuit.

Figure 3B:
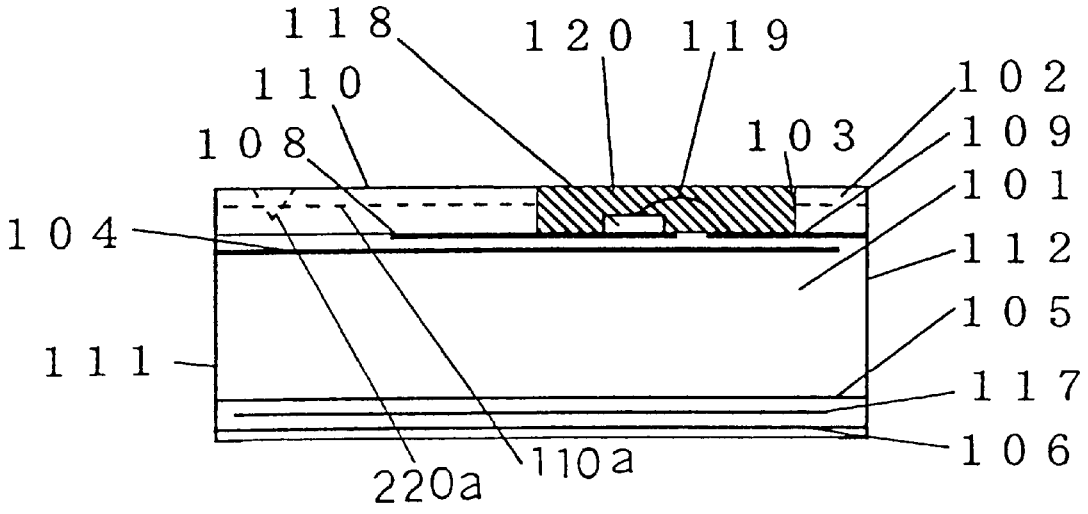
FIG. 3(B) is a side cross-sectional view of the voltage-controlled resonator when an element encased in a plastic package is used as a variable-capacitance element in the same embodiment.

Further, in FIGS. 1(A), 1(B), and 2, the variable-capacitance element used is a plastic packaged type (as indicated by reference numeral 107 in the figures), but this element need not be limited to this particular type; for example, as shown in FIG. 3(B), the element 118, housed inside the plastic package, may be mounted by itself directly on the electrode film 108 and connected to the electrode film 109 with a wire 119. In that case, it is preferable to fill the through-hole 103 with a resin 120 to protect the element 118.

The structure shown in FIGS. 1(A), 1(B), and 2 is suitable for being implemented with a dielectric lamination consisting of a plurality of dielectric green sheets 100*a* to 102*a*, 105*a*, 106*a*, and 117*a*.

As described above, in the voltage-controlled resonator of the present embodiment, the first dielectric where the resonant circuit is formed is covered with the second dielectric in which the through-hole is formed, and the grounding electrode film is formed over the second dielectric. This structure has the effect of enhancing the shielding property of the resonant circuit without increasing its size. The method of fabricating this voltage-controlled resonator will be described in detail below.

One embodiment of the fabrication method for the voltage-controlled resonator according to the present invention will be described with reference to the exploded perspective view of the voltage-controlled resonator shown in FIG. 2.

As shown in the figure, first, the electrode film 115 forming the choke circuit, the electrode films 108 and 113 forming capacitors, and the electrode film 109 forming the variable-capacitance element are formed on the upper surface of the thin dielectric green sheet 100*a*. Further, the electrode film 104 forming the resonator is formed on the upper surface of the thick dielectric green sheet 101*a*. Further, the grounding electrode film 105 is formed on the upper surface of the thin dielectric green sheet 105*a*. Likewise, the electrode film 117 forming a capacitor is formed on the upper surface of the dielectric green sheet 117*a*, and the grounding electrode film 106 is formed on the upper surface of the dielectric green sheet 106*a*. These electrode films are formed by printing conductive materials as thin films. The dielectric green sheets with the respective electrode films formed thereon are laminated one on top of another in the order stated above, to complete the fabrication of the first dielectric 101.

Next, a conductive material is printed as a thin film on the upper surface of the dielectric green sheet 102*a*, to form the grounding electrode film 110, and the through-hole 103 is formed by punching. In this way, the second dielectric 102 is fabricated.

Thereafter, the first dielectric 101 and the second dielectric 102 are laminated together, and the laminated structure is baked. In this way, the two dielectrics 101 and 102 are bonded together, to complete the fabrication of the entire dielectric structure.

Thereafter, the grounding terminal electrodes 111 and 112 and the terminal electrodes 114 and 116 are formed by applying conductive materials on the respective sides of the dielectric structure.

Finally, the variable-capacitance element 107 is mounted on the dielectric structure. That is, the variable-capacitance element 107 is inserted through the through-hole 103 and electrically connected to the electrode films 108 and 109.

With the above process, the fabrication of the voltage-controlled resonator of the present embodiment is completed.

As can be seen, while the prior art fabrication method has required a separate process for mounting the shield case 311 (see FIG. 5(D)) after the lamination process, the above-described process does not require such a separate process. Thus the fabrication process can be further simplified according to the present embodiment.

(Embodiment 2)

Next, a method of tuning the voltage-controlled resonator according to one embodiment of the present invention will be described with reference to drawings.

Figure 4A:
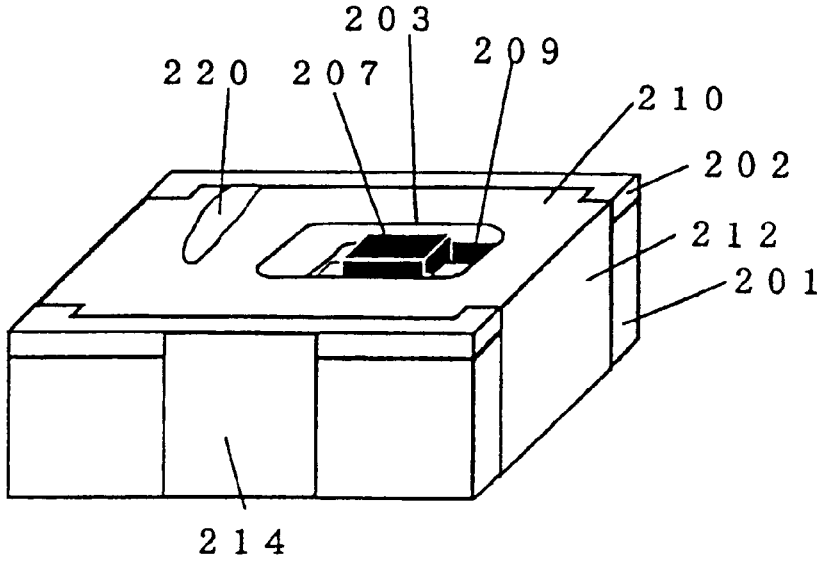
FIG. 4(A) is a perspective view showing how the tuning of the voltage-controlled resonator is accomplished according to a second embodiment of the present invention.
Figure 4B:
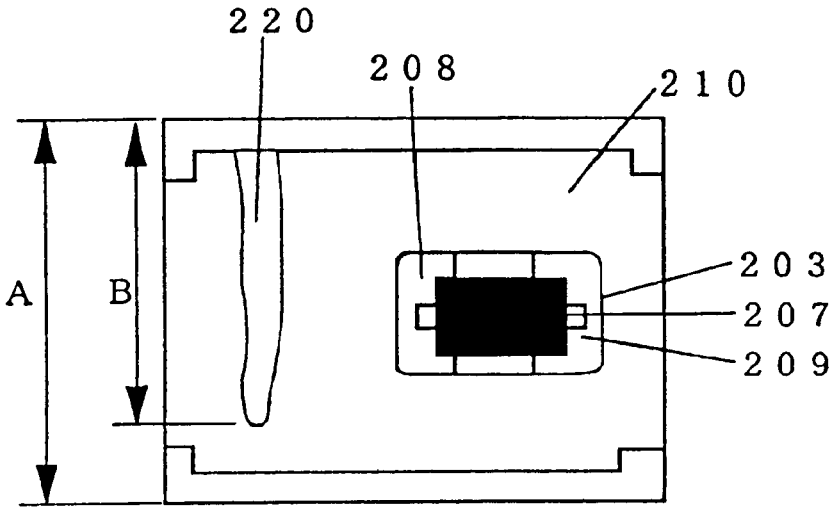
FIG. 4(B) is a top view showing how the tuning of the voltage-controlled resonator is done according to the second embodiment of the present invention.

FIG. 4(A) is a perspective view showing how the tuning of the voltage-controlled resonator is accomplished according to a second embodiment of the present invention, and FIG. 4(B) is a top view showing how the tuning of the voltage-controlled resonator is done.

In FIGS. 4(A) and 4(B), reference numerals 201, 202, 203, 207, 208, 209, 210, 212, and 214 respectively correspond to the reference numerals 101, 102, 103, 107, 108, 109, 110, 112, and 114 in FIGS. 1(A) and 1(B). A shaved portion 220 for tuning is formed by partially shaving the grounding electrode film 210 to tune the frequency of the voltage-controlled resonator. In FIGS. 4(A) and 4(B), by shaving the grounding electrode film 210 as shown by the shaved portion 220 for tuning, the current flowing through the grounding electrode film 210 is diverted around the shaved portion 220 formed for tuning, as a result of which the resonant frequency lowers. Here, the grounding electrode film 110 (shield film) is partially shaved off by avoiding the main portion thereof that plays an important part in providing the shielding effect. More specifically, as shown in FIG. 4(B), the shaved portion 220 is formed in an area other than those areas of the grounding electrode film 110 which cover the major circuit patterns (such as the electrode film 115 forming the choke circuit) formed on the dielectric green sheet 100*a* shown in FIG. 2.

Assume, for example, that the resonant frequency of the voltage-controlled resonator before shaving the grounding electrode film 210 is 1780 MHz. Then, by forming the shaved portion 220 for tuning in such a manner that the ratio of A to B shown in FIG. 4(B) becomes 4:3, the resonant frequency can be accurately tuned to the design value (target value) of 1724 MHz. Furthermore, since there is no need to provide the shield case 311 required in the prior art construction shown in FIG. 5(D), the effect of ambient interference on the resonant frequency of the voltage-controlled resonator is reduced to almost nil. Accordingly, before and after forming the shaved portion 220 for tuning, the resonant frequency remains essentially the same. On the other hand, in the case of the voltage-controlled resonator for the 1.6 to 1.7 GHz band according to the prior art construction shown in FIG. 5(D), the resonant frequency after the tuning can at best be controlled within a range of plus or minus 5 MHz around the design value.

In this way, with the resonator tuning method for the voltage-controlled resonator incorporating a shield film having a dual function of shielding and resonant frequency tuning according to the present embodiment, the tuning of the resonant frequency can be accomplished easily by shaving the grounding electrode film of the voltage-controlled resonator, and the shift in the resonant frequency caused by external interference can also be reduced to a minimum.

Furthermore, when the voltage-controlled resonator of the above embodiment is used in a mobile communication apparatus such as a portable telephone, the communication apparatus can be reduced in size since the size of the transmission circuit can be reduced as described above.

The above embodiments have been described dealing with the case where the shield film of the present invention is formed on the surface of the second dielectric, but the invention is not limited to the illustrated embodiments. For example, the second dielectric may be formed in a multi-layered structure with the shield film sandwiched between the multiple layers. In this case, since the shield film is formed inside the second dielectric, when tuning the resonant frequency the second dielectric must be shaved deep enough to reach the inside shield film. The tuning of the resonant frequency can thus be performed by working from the upper surface of the second dielectric as in the above-described structure, so that the same effect as described above can be obtained. The shield film 110*a* and shaved groove 220*a* in this alternative structure are shown by dashed lines in FIG. 3(B).

The description of the above embodiments has also dealt with the case where the shield film of the present invention is electrically grounded to an apparatus circuit board, but instead, the shield film may of course be electrically insulated from the other portions.

As is apparent from the above description, the present invention has the advantage that the height of the voltage-controlled resonator can be further reduced while retaining the shielding effect.

The present invention has the further advantage that the fabrication method for the voltage-controlled resonator can be further simplified.

In addition to the above advantages, the present invention provides the advantage that further precise tuning of the resonant frequency can be accomplished as compared with the prior art.

What is claimed is:

1. A voltage-controlled resonator, comprising:

a first dielectric;

a resonant circuit formed inside and/or on the first dielectric, the resonant circuit including a first plurality of circuit elements;

a second plurality of circuit elements on a surface of the first dielectric, the second plurality including at least a choke circuit and a capacitor film;

a variable-capacitance element mounted on an upper surface of said first dielectric;

a second dielectric provided over the upper surface of the first dielectric, and defining a through-hole at a position corresponding to a position of said variable-capacitance element; and a shield film on or inside the second dielectric so as to shield elements that determine the resonant frequency of the resonant circuit, the circuit elements shielded by the shield film including a portion of the resonant circuit and the second plurality of circuit elements.

2. A voltage-controlled resonator according to claim 1, wherein said shield film is formed on a surface of said second dielectric opposite from a surface of said second dielectric facing said first dielectric.

3. A voltage-controlled resonator as recited in claim 2, wherein a portion of the shield firm is removed for tuning of the resonator.

4. A voltage-controlled resonator according to claim 3, wherein said shield film is removed in an area other than a major circuit pattern which has a dominant effect upon a whole character of the voltage-controlled resonator.

5. A voltage-controlled resonator as recited in claim 1, wherein a portion of the shield film is removed for tuning of the resonator.

6. A voltage-controlled resonator according to claim 5, wherein said shield film is removed in an area other than a major circuit pattern which has a dominant effect upon a whole character of the voltage-controlled resonator.

7. A voltage-controlled resonator according to claim 1, wherein said shield film is formed inside said second dielectric.

8. A voltage-controlled resonator as recited in claim 7, wherein a portion of the second dielectric to a depth reaching the shield film is removable, and a portion of said shield film is removable.

9. A voltage-controlled resonator according to claim 8, wherein said shield film is removed in an area other than a major circuit pattern which has a dominant effect upon a whole character of the voltage-controlled resonator.

10. A method of fabricating a voltage-controlled resonator, comprising:

forming a resonant circuit that includes a first plurality of circuit elements inside and/or on a first dielectric sheet;

forming a second plurality of circuit elements on a surface of the first dielectric sheet, the second plurality including at least a choke circuit and a capacitor film;

forming a shield film on or inside a second dielectric sheet;

forming a through-hole of a predetermined shape through the shield film and the second dielectric sheet;

laminating said first dielectric sheet and said second dielectric sheet together such that the shield film shields shielded circuit elements that determine the resonant frequency of the resonant circuit, the shielded circuit elements including a portion of the resonant circuit and the second plurality of circuit elements; and mounting a variable-capacitance element on a circuit pattern through said through-hole.

11. A method of fabricating a voltage-controlled resonator according to claim 10, wherein said shield film is formed inside said second dielectric sheet.

12. A method of fabricating a voltage-controlled resonator as recited in claim 11, further including removing a portion of the second dielectric sheet to a depth reaching the shield film, and removing a portion of said shield film to tune the voltage-controlled resonator.

13. A method of fabricating a voltage-controlled resonator according to claim 12, wherein said shield film is removed in an area other than a major circuit pattern which has a dominant effect upon a whole character of the voltage-controlled resonator.

14. A method of fabricating a voltage-controlled resonator according to claim 10, wherein said shield film is formed on a surface of said second dielectric sheet opposite from a surface of the second dielectric sheet facing the first dielectric sheet.

15. A method of fabricating a voltage-controlled resonator as recited in claim 14, further including removing a portion of the shield film to tune the voltage-controlled resonator.

16. A method of fabricating a voltage-controlled resonator according to claim 15, wherein said shield film is removed in an area other than a major circuit pattern which has a dominant effect upon a whole character of the voltage-controlled resonator.

17. A method of fabricating a voltage-controlled resonator as recited in claim 10, further including removing a portion of the shield film to tune the voltage-controlled resonator.

18. A method of fabricating a voltage-controlled resonator according to claim 17, wherein said shield film is removed in an area other than a major circuit pattern which has a dominant effect upon a whole character of the voltage-controlled resonator.

19. A mobile communication apparatus including a voltage-controlled resonator including a first dielectric;

a resonant circuit formed inside and/or on the first dielectric, the resonant circuit including a first plurality of circuit elements;

a second plurality of circuit elements on a surface of the first dielectric, the second plurality including at least a choke circuit and a capacitor film;

a variable-capacitance element mounted on an upper surface of said first dielectric;

a second dielectric provided over the upper surface of the first dielectric, and defining a through-hole at a position corresponding to a position of said variable-capacitance element; and a shield film on the second dielectric so as to shield circuit elements that determine the resonant frequency of the resonant circuit, the circuit elements shielded by the shield film including a portion of the resonant circuit and the second plurality of circuit elements.

20. A mobile communication apparatus including a voltage-controlled resonator fabricated by a voltage-controlled resonator fabrication method including the steps of forming a resonant circuit that includes a first plurality of circuit elements inside and/or on a first dielectric sheet;

forming a second plurality of circuit elements on a surface of the first dielectric sheet, the second plurality including at least a choke circuit and a capacitor film;

forming a shield film on or inside a second dielectric sheet corresponding to the resonant circuit;

forming a through-hole of a predetermined shape through the shield film and the second dielectric sheet;

laminating said first dielectric sheet and said second dielectric sheet together such that the shield film shields shielded circuit elements that determine the resonant frequency of the resonant circuit, the shielded circuit elements including a portion of the resonant circuit and the second plurality of circuit elements; and mounting a variable-capacitance element on a circuit pattern through said through-hole.

21. A mobile communication apparatus including a voltage-controlled resonator including, a first dielectric;

a resonant circuit formed inside and/or on the first dielectric, the resonant circuit including a first plurality of circuit elements;

a second plurality of circuit elements on a surface of the first dielectric, the second plurality including at least a choke circuit and a capacitor film;

a variable-capacitance element mounted on an upper surface of said first dielectric;

a second dielectric provided over the upper surface of the first dielectric, and defining a through-hole at a position corresponding to a position of said variable-capacitance element; and a shield film on the second dielectric so as to shield circuit elements that determine the resonant frequency of the resonant circuit, the circuit elements shielded by the shield film including a portion of the resonant circuit and the second plurality of circuit elements; and wherein a portion of the shield film is removed for tuning of the resonator.

22. A mobile communication apparatus including a voltage-controlled resonator fabricated by a method including the steps of forming a resonant circuit that includes a first plurality of circuit elements inside and/or on a first dielectric sheet;

forming a second plurality of circuit elements on a surface of the first dielectric sheet, the second plurality including at least a choke circuit and a capacitor film;

forming a shield film on or inside a second dielectric sheet corresponding to the resonant circuit;

forming a through-hole of a predetermined shape through the shield film and the second dielectric sheet;

laminating said first dielectric sheet and said second dielectric sheet together such that the shield film shields shielded circuit elements that determine the resonant frequency of the resonant circuit, the shielded circuit elements including a portion of the resonant circuit and the second plurality of circuit elements; and mounting a variable-capacitance element on a circuit pattern through said through-hole, and wherein a portion of the shield film is removed to tune the resonator.

* * * * *